US007501957B1

(12) United States Patent
Plottke

(10) Patent No.: US 7,501,957 B1
(45) Date of Patent: Mar. 10, 2009

(54) TAMPERPROOF BOTTLE LOCKING SYSTEM

(76) Inventor: Ed Plottke, 13674 W. Center, Burton, OH (US) 44021-9539

( * ) Notice: Subject to any disclaimer, the term of this patent is extended or adjusted under 35 U.S.C. 154(b) by 427 days.

(21) Appl. No.: 11/371,063

(22) Filed: Mar. 9, 2006

(51) Int. Cl.
*G08B 13/14* (2006.01)

(52) U.S. Cl. ..... 340/572.8; 340/572.8

(58) Field of Classification Search ..... 340/572.8, 340/572.1, 572.9; 215/210, 280
See application file for complete search history.

(56) References Cited

U.S. PATENT DOCUMENTS

| | | | | |
|---|---|---|---|---|
| 173,061 | A * | 2/1876 | Robard | 215/207 |
| 3,578,196 | A * | 5/1971 | Ender | 215/207 |
| 5,509,550 | A | 4/1996 | DeJonge | |
| 5,602,530 | A | 2/1997 | Holmgren | |
| 5,620,652 | A * | 4/1997 | Tack et al. | 420/532 |
| 5,769,252 | A | 6/1998 | Volpe | |
| 6,769,557 | B2 | 8/2004 | Michael et al. | |
| 2004/0057233 | A1 * | 3/2004 | Sharrah et al. | 362/205 |
| 2005/0012618 | A1 * | 1/2005 | Pempsell et al. | 340/572.8 |
| 2006/0132311 | A1 * | 6/2006 | Kruest et al. | 340/572.4 |

* cited by examiner

*Primary Examiner*—Daniel Wu
*Assistant Examiner*—Shirley Lu
(74) *Attorney, Agent, or Firm*—Joseph H. Taddeo

(57) ABSTRACT

The present invention provides for a tamperproof bottle locking system, comprising a flanged outer cap apparatus having a pair of pivoted semicircular arm members that when fully closed beneath the protruding circumferential neck ring of a bottle and locked with a detachable lock, by passing the unhinged end of a U-shaped shackle of the lock through the end holes of the arm members, swiveling it closed, and snapping it shut, securely locks the outer cap device of the present invention, preventing its removal, thereby protecting the contents of the bottle from being tampered with.

3 Claims, 9 Drawing Sheets

TAMPERPROOF BOTTLE LOCKING SYSTEM

FIELD OF INVENTION

The present invention relates primarily to a tamperproof bottle locking system, and more particularly to a bottle locking apparatus that is retained by two pivoted members engaging below the threaded neck portion of the bottle and secured with a miniature, keyed lock.

BACKGROUND OF THE INVENTION

There exists a plethora of child resistant caps, with thousands of variations in functionality and in design, as well as, bottle security devices that attach to the neck of a bottle. These types of protective caps may be typically utilized for securing medicines, vitamins and other materials stored in threaded neck containers.

The following prior art discloses the various aspects in the design and use of bottle locking apparatuses.

U.S. Pat. No. 5,509,550, granted Apr. 23, 1996, to S. W. DeJonge, discloses a child resistant cap with automatic release key, where the child resistant cap device is for containers with a threaded neck openings. It includes an inner cap, an outer cap and a key bar. The inner cap has a top and a sidewall having threads on its inside. The sidewall has on its outside, one of a male attaching mechanism and a female attaching mechanism for receiving and attaching the outer cap onto the inner cap so as to be rotatably fixed thereon. The top of the inner cap has a release key engagement on its outside, and the outside of the inner cap also has one way ratchets or ratchet blocks to permit engagement of the outer cap for rotating thereon, in a single, closing direction and preventing engagement of them for rotating them in a single, opposite, opening direction. The outer cap has a top and a sidewall having on its inside the other of a male attaching mechanism and a female attaching mechanism. The top of the outer cap has a release key bar with a key that is pivotable for 180 degree rotation so as to be engageable with the key arrangement of the inner cap so as to permit opening of the inner cap by rotation of the outer cap when the release key is engaged in the release key engagement.

U.S. Pat. No. 5,602,530, granted Feb. 11, 1997, to B. Holmgren, discloses an anti-theft device for bottles, where the invention relates to an anti-shop lifting device, intended to be passed onto and locked to a bottle-neck having an external circumferential bead. The device comprises an outer socket that can be shifted in relation to an inner socket between two end positions and is locked by latch means in one end position. A number of retainers distributed peripherally on the inner surface of the outer socket, when the outer socket is in said one end position extend into the inner socket through openings in the wall of said inner socket to an engaged position in which the retainers engage behind the bead of the bottle-neck in order to prevent the anti-shop-lifting device form being withdrawn. The latch means is biased to latching position but can be actuated by means of an external element to a disengaged position against the bias in order to allow movement of the retainers from the engaged position and thus withdrawal of the anti-shop-lifting device from the bottle-neck.

U.S. Pat. No. 5,769,252, granted Jun. 23, 1998, to A. S. Volpe, discloses a container closure which converts from a child resistant to a non-child resistant configuration, where the container closure can be converted from a child resistant configuration to a non-child resistant configuration. The container closure includes an external cap, an internal cap and a locking element. The locking element is inserted between the external cap and internal cap to form the non-child resistant configuration.

U.S. Pat. No. 6,769,557, granted Aug. 3, 2004, to R. L. Michael, et al., discloses a bottle security device includes an inner member and an outer member that cooperate to lock the bottle security device on the neck of a bottle. The inner member includes a plurality of fingers that are adapted to fit under the bead on a bottleneck. The inner member further includes outwardly extending teeth. The outer sleeve member of the device slides over the inner member and forces the fingers against the bottle. The outer sleeve member further includes a plurality of upwardly extending arms that have inwardly projecting teeth that engage the teeth of the inner member to lock the two members together. A key is used to separate the two pieces and release the security device from the bottle. The key extends down through the top of the outer sleeve member to physically engage the upwardly extending arms and to move them radially outward to where they disengage the inner member.

What is needed is a tamperproof bottle locking system comprising an apparatus that encloses a conventional cap onto the capped threaded neck of a bottle. In this regard, the present invention fulfils this need.

It is therefore an object of the present invention to provide a tamperproof bottle locking apparatus that fully encompasses and securely retains the cap of a bottle.

It is another object of the present invention to provide a tamperproof bottle locking apparatus that fully encompasses and securely retains the cap of a bottle by utilizing a miniature keyed lock.

It is still another object of the present invention to provide a tamperproof bottle locking apparatus that fully encompasses and securely retains the cap of a bottle by having two pivoted semicircular members engage below the threaded neck portion of the bottle It is still yet another object of the present invention to provide a tamperproof bottle locking apparatus that is easily removed by unlocking and removing the keyed locking device, opening the pivoted semicircular members and removing the present invention.

A final object of the present invention is to provide a tamperproof bottle locking apparatus that can also be used as a security and antitheft device by imbedding a security device inside the outer cap on the inner surface at the top of the present invention.

A better understanding of these and other objects and advantages of the present invention will be best understood from the following description of the specific embodiments when read and understood in connection with the accompanying drawings.

SUMMARY OF THE INVENTION

The present invention relates primarily to a tamperproof bottle locking system, comprising a flanged outer cap apparatus having a pair of pivoted semicircular arm members that when fully closed beneath the protruding circumferential neck ring of a bottle and locked with a detachable lock, by passing the unhinged end of a U-shaped shackle of the lock through the end holes of the arm members, swiveling it closed, and snapping it shut, securely retains the outer cap device of the present invention, thereby protecting the contents of the bottle from being tampered with by securely locking it and preventing its removal.

BRIEF DESCRIPTION OF THE DRAWINGS

A complete understanding of the invention may be obtained by reference to the accompanying drawings when taken in conjunction with the detailed description.

DETAILED DESCRIPTION OF THE PRESENT INVENTION

A system and apparatus are provided in accordance with the present invention to allow for the tamperproof protection of the contents of a bottle. This device finds use for containers having capped, threaded neck openings, and preferably having a circumferential protruding neck ring below the threaded portion, such as with vitamin bottles, medicine bottles, as well as bottles having contents that should be protected from being used by children and the other individuals. The present invention then provides for an easy, as well as, economical installation of a protective apparatus to secure the contents of a bottle from being tampered with by a young child or other persons, thereby rendering the system as being childproof and tamperproof.

Figure 1:
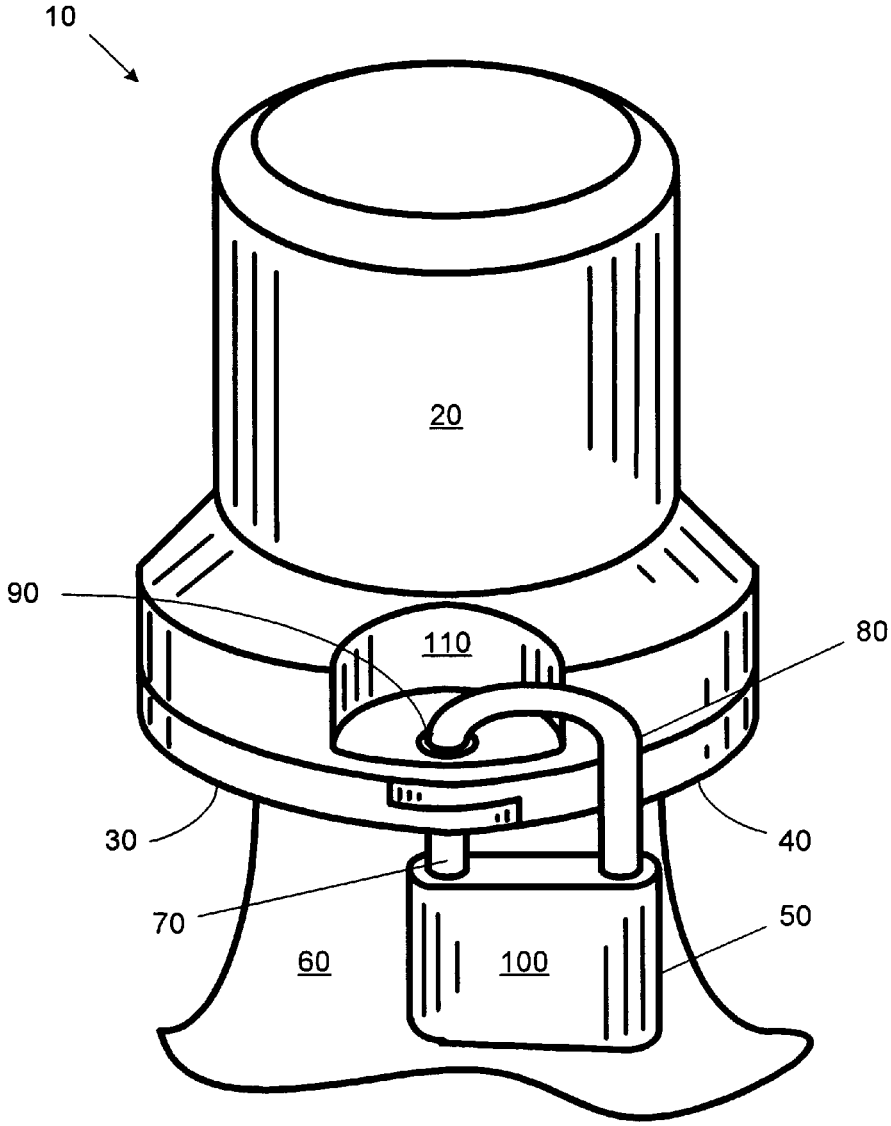
FIG. 1 is a perspective view of the novel tamperproof bottle locking system.

Turning now to FIG. 1, there is shown the present invention, a tamperproof bottle locking system 10, comprising the flanged outer bottle-locking cap 20, left and right pivoted semicircular members, 30 and 40, the detachable padlock 50, and the secured threaded container, bottle 60. Shown in the locked tamperproof condition, the unhinged 70 of the U-shaped shackle 80 of detachable padlock 50 is passed through the aligned shackle holes 90, 90A and 90B, where the body 100 of the padlock 50 is swiveled about the hinged end to align the shackle 80 for the proper closure of the padlock 50.

The lower cylindrical portion of the bottle-locking cap 20 is formed into the flanged segment 130, where the semicircular locking members 30 and 40 are secured beneath the flanged segment 130. A curved indentation 110 into the flanged segment 130 allows the hole 90 in the base of the indented area on the flange to become aligned with the hole 90A located at the end of the right pivoted semicircular member 30 and hole 90B located at the end of the left pivoted semicircular member 40, where the semicircular members 30 and 40 close beneath the protruding circumferential neck ring 140 of the bottle 60 and locked with a detachable lock 50, by passing the unhinged end 70 of a Unshaped shackle 80 of the lock through the flange hole 90 and end holes of the arm members 90A and 90B, swiveling it closed, and snapping it shut, to securely retain the outer cap device of the present invention.

Figure 2:
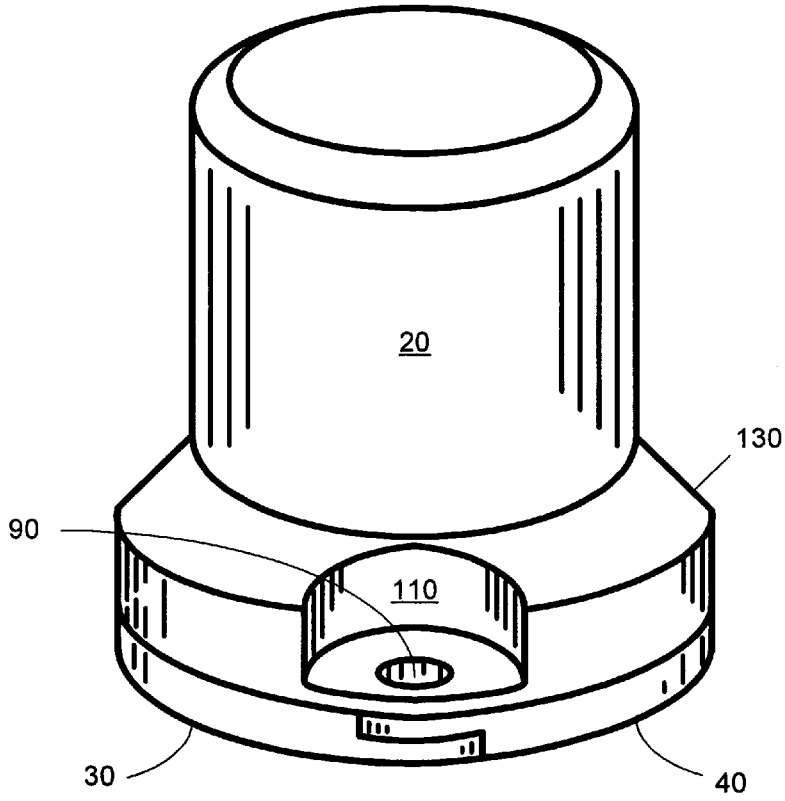
FIG. 2 is a perspective view of the novel tamperproof bottle-locking cap, with the padlock removed.
Figure 3:
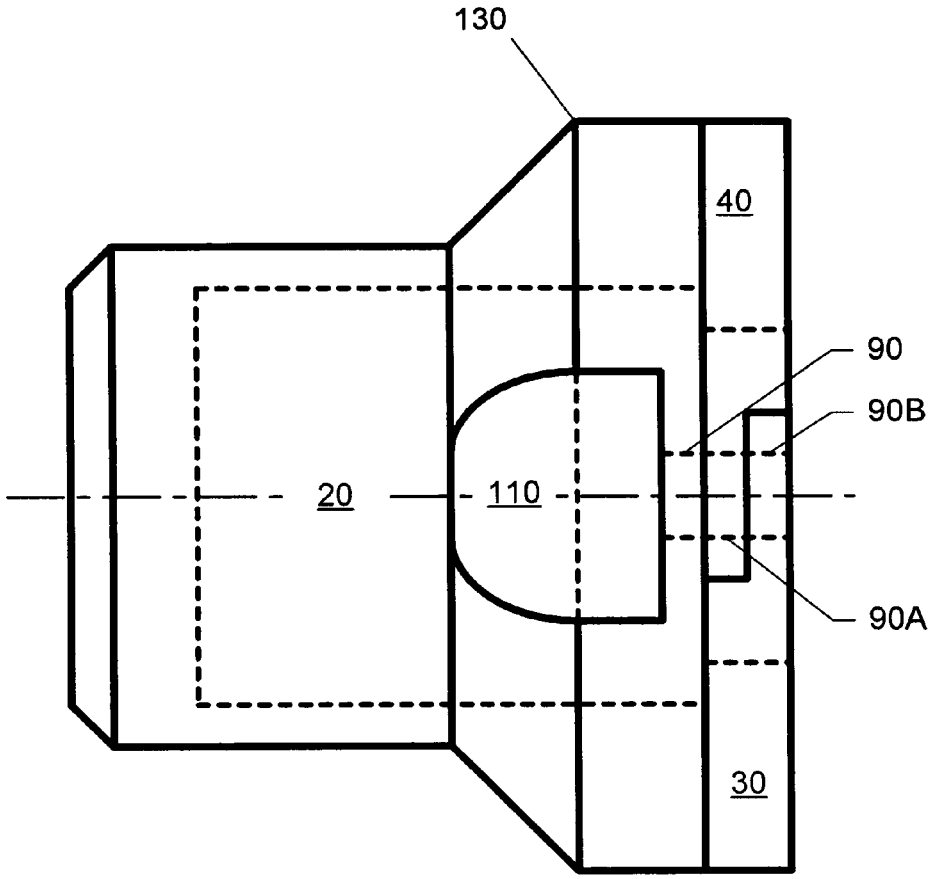
FIG. 3 is a side elevational view of the novel tamperproof bottle-locking cap, with the padlock removed.
Figure 4:
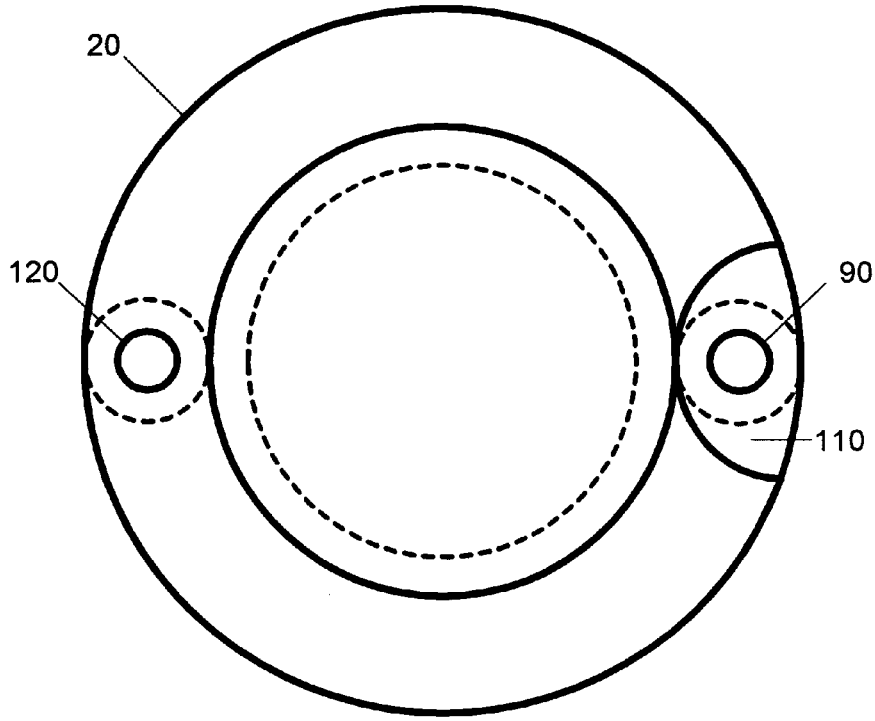
FIG. 4 is a top view of the novel tamperproof bottle locking cap.

There is shown in FIGS. 2, 3 and 4, the tamperproof bottle-locking cap 20 with the padlock, locking device 50 removed. The semicircular arm members 30 and 40 are in fully closed position, with the shackle holes 90, 90A and 90B in alignment.

Figure 5:
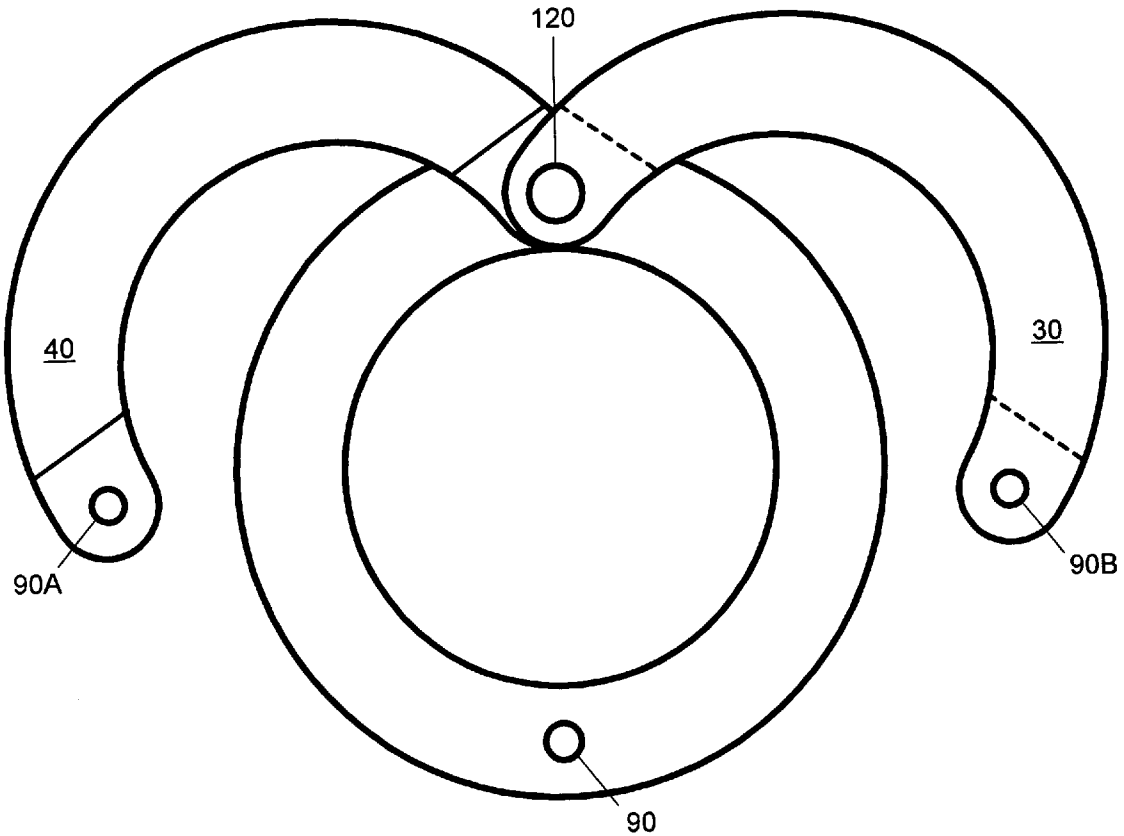
FIG. 5 is a bottom view of the bottle neck closure arms in a fully extended position.
Figure 6:
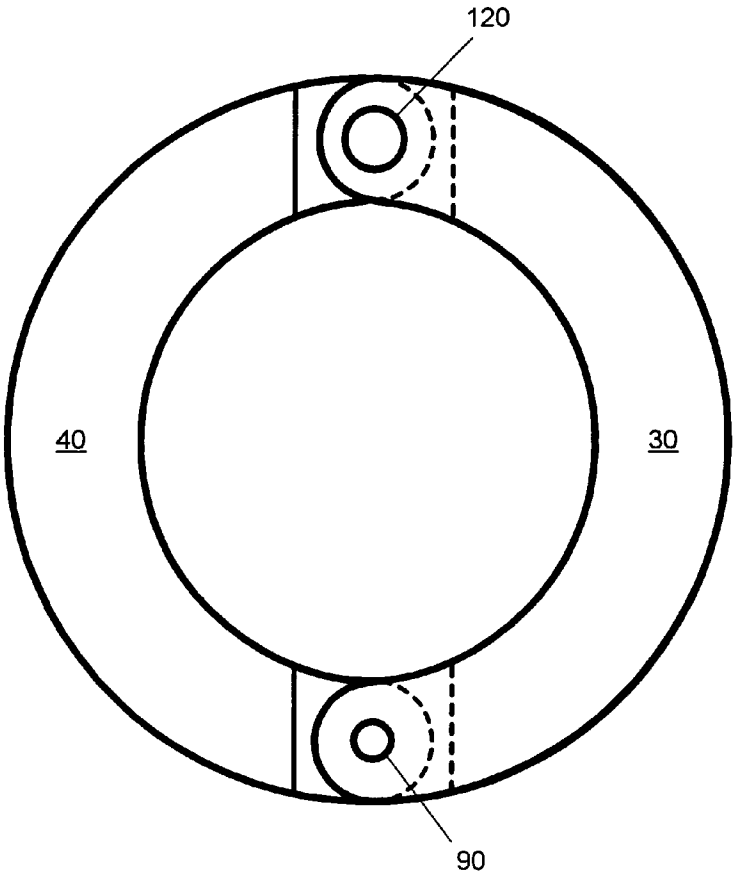
FIG. 6 is a bottom view of the bottle neck closure arms in the fully closed position.

FIG. 5 shows in a bottom view, the semicircular arm members 30 and 40 in an open extended position, whereas in FIG. 6 shows the semicircular arm members 30 and 40 in the closed locking position.

Figure 7:
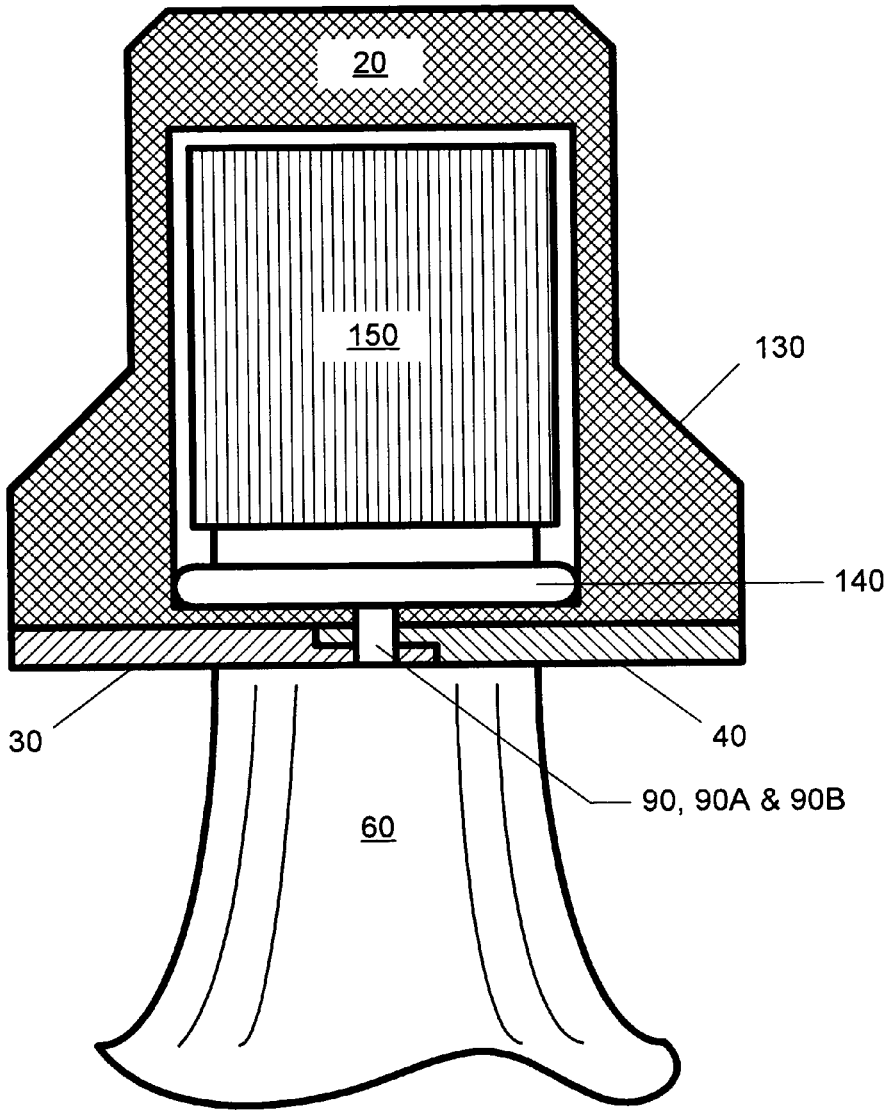
FIG. 7 is a side view of the tamperproof bottle-locking cap captivating the inner bottle cap by having the closure arms fully closed around the neck below the protruding circumferential ring around the neck of the bottle.

Referring now to FIG. 7, there is shown in section, the outer tamperproof locking cap 20 of the present invention securely encompassing the inner cap 150 of a typical bottle 60. The semicircular arm members 30 and 40 are fully closed, with the end holes 90A and 90B in alignment with hole 90, in a state of readiness to receive the unhinged shackle 70 of padlock 50. The semicircular arm members 30 and 40 are positioned to engage each other below the protruding circumferential neck ring 140 of bottle 60.

Figure 8:
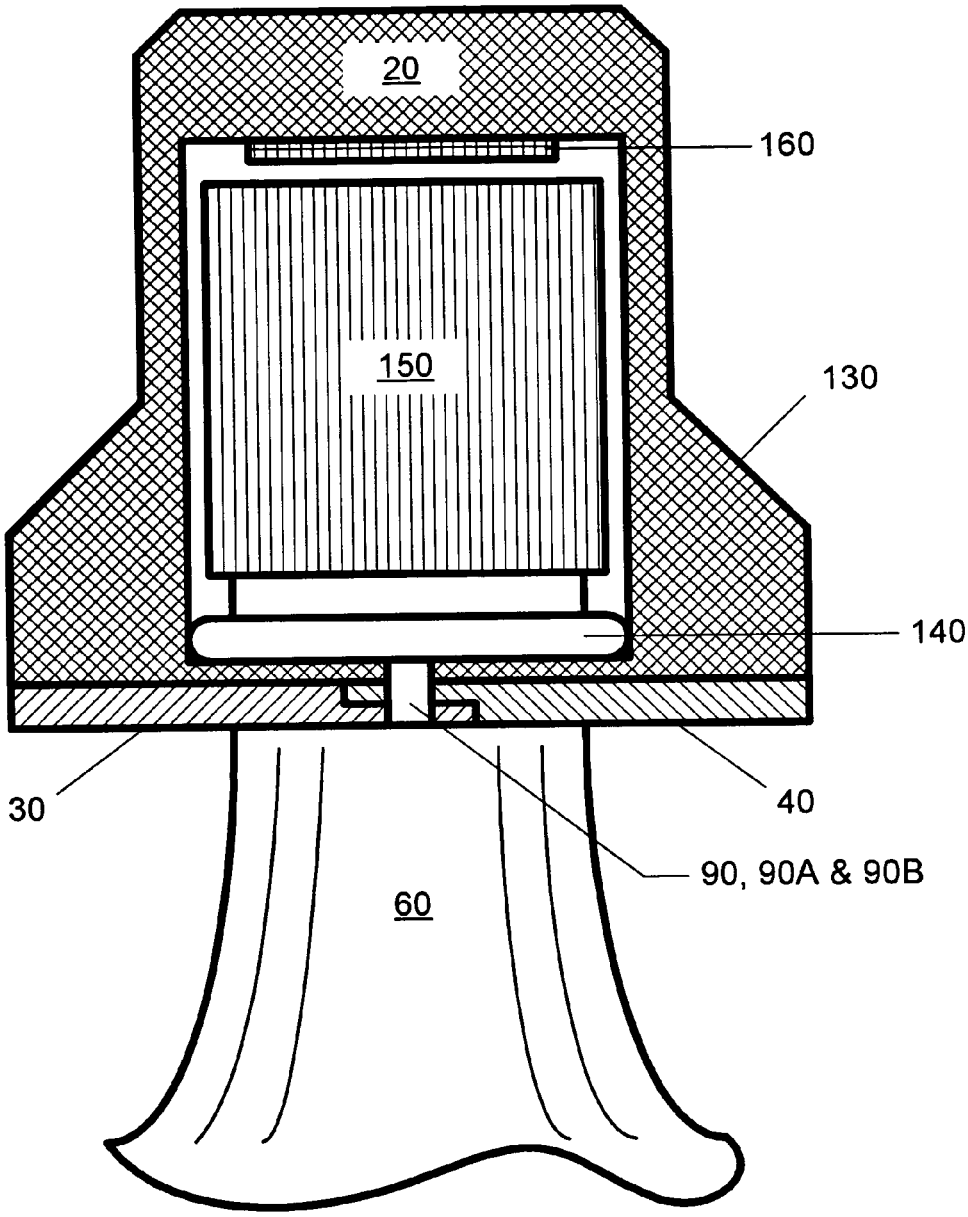
FIG. 8 is a side sectional view of the tamperproof bottle-locking cap captivating the inner bottle cap by having the closure arms fully closed around the neck below the protruding circumferential ring around the neck of the bottle and having a security device adhered to the interior surface of the upper portion of the outer cap.

In another aspect of the present invention, there is shown in FIG. 8, the preferred placement of a security device 160, where it is adhered to the interior surface of the upper portion of the outer cap 20 of the present invention. In this manner, the present invention is augmented into being an anti-theft deterrent as well as being a tamperproof system, where it can be detected by anti-theft equipment should it pass through the detector without being first removed.

Figure 9:
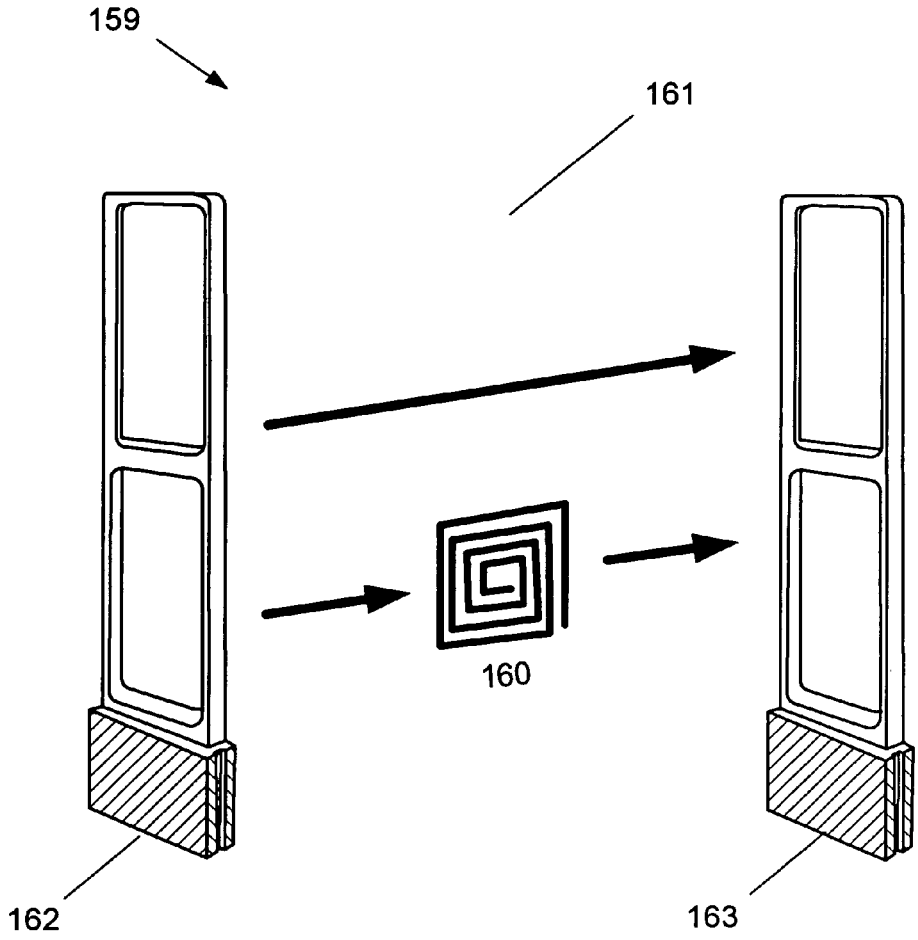
FIG. 9 discloses operation of the electronic article surveillance system (EAS) wherein a tag constructed of a steel magnetic ribbon, saturated by a magnetic flux, passes through a gate with a transmitter antenna signal to a receiver antenna, that triggers an alarm when a specific, unique frequency pattern, consequent to an interference of the tag is detected and recognized.

The alarm system that coordinates with the magnetic tag is disclosed in FIG. 9. On the underside and inside of the Bottle Lock Cap 20, the security device, is a tag which consists of a steel magnetic ribbon 160 that has a high permeability, making it easy for magnetic signals to flow through it. When we drive the tag 160, magnetic flux is allowed to flow though the tag until it's saturated. Once it is saturated, from a magnetic perspective, it begins to look like, give the manifestation of, air.

The electromagnetic alarm system (EM) and electronic article surveillance (EAS) system 159 functions by applying intensive low frequency magnetic fields generated by the transmitter antenna 162. When the activated strip passes through the gate, it will transmit a unique frequency patter. This pattern is, in turn, is picked up by an adjacent receiver antenna 163. The small signal is processed and triggers an alarm when a specific pattern, carried off by the strip, is detected and recognized. Because of the weak response of the strip and the low frequency, typically between 70 Hz and 1 kHz, an intensive field is required by the EM system 159.

Once the strip 160 is activated, and it passes through an EM deter 161, which is a Swept-RF with a Swept Transmitter Signal, it will trigger an alarm, alerting the store personnel that security had been breached. Removal of the bottle lock cap allows the that patron to exit—and the bottle lock cap is available for reuse without the need to reactivate the locking cap 20.

Whereas the present invention is described in detail for its particular embodiments, there may be other variations and modifications that will become parent to those skilled in the art upon reading this specification, and that these modifications or variations can be made without detracting from the true spirit of this invention.

The invention claimed is:

1. A tamperproof bottle locking apparatus for containers having capped, threaded neck openings and a circumferential protruding neck ring below the threaded portion, the apparatus comprising a flanged outer bottle-locking cap with left and right semicircular members that are pivotally connected together on a hinged end and further pivotally connected to the outer bottle-locking cap, each unhinged end of the two pivot members having a shackle hole and the outer bottle-locking cap having a curved indentation into a flanged segment of the cap with a hole in the base of the indentation, wherein the pivot members close in an overlap engagement below the threaded neck portion of the bottle, the respective shackle holes align with the hole in the base, and the tamperproof locking cap securely encompasses the container neck when each arm member is swiveled closed, an end of a U-shaped lock shackle is passed through the base hole on the indentation and the end hole of each arm member, and the lock is snapped shut, wherein the tamperproof bottle locking apparatus encircles the container neck and the bottle contents are protected from tampering by a miniature keyed padlock preventing its removal;

wherein a cylindrical portion of the bottle locking cap is formed into the flanged segment and the pivot members are secured to each other and secured to the flanged cap in two locations beneath the flanged segment for security of the container;

the tamperproof bottle locking apparatus further comprising in combination a security device integrated with the flanged outer bottle locking cap, the security device detectable by an anti-theft equipment when passed through a detector; wherein the security device comprises a tag of steel magnetic ribbon with a high permeability that facilitates a flow of magnetic signals through the tag and an electromagnetic alarm system (EM) that coordinates with the magnetic tag; wherein the tag is saturated with a magnetic flux that provides the tag with an activated strip having, from a magnetic perspective, an appearance or manifestation of air;

wherein the EM includes an electronic article surveillance (EAS) system that applies an intensive low frequency magnetic field generated by a transmitter antenna to a receiver antenna in a unique frequency pattern, which is altered when the activated strip with its unique transmitted frequency pattern passes through the field, a signal is processed and triggers an alarm when the frequency pattern, carried by the strip, is detected and recognized.

2. A tamperproof bottle locking apparatus for containers as defined in claim 1, wherein the security device is imbedded inside the outer cap.

3. The tamperproof bottle locking apparatus for containers as defined in claim 2, wherein removal of the bottle locking apparatus from the container allows a patron to exit, whereupon the security device of the bottle lock cap is available for reuse without a need to reactivate the strip.

* * * * *